US010709931B2

(12) United States Patent
Akihiro

(10) Patent No.: US 10,709,931 B2
(45) Date of Patent: Jul. 14, 2020

(54) LIP TRAINER

(71) Applicant: Actwell Technology Inc., Taipei (TW)

(72) Inventor: Takashi Akihiro, Taipei (TW)

(73) Assignee: Actwell Technology Inc., Taipei (TW)

( * ) Notice: Subject to any disclaimer, the term of this patent is extended or adjusted under 35 U.S.C. 154(b) by 13 days.

(21) Appl. No.: 16/147,841

(22) Filed: Sep. 30, 2018

(65) Prior Publication Data

US 2019/0105532 A1 Apr. 11, 2019

(30) Foreign Application Priority Data

Oct. 6, 2017 (TW) ..... 106134475 A

(51) Int. Cl.
*A63B 23/03* (2006.01)

(52) U.S. Cl.
CPC ..... *A63B 23/032* (2013.01)

(58) Field of Classification Search
CPC ..... A63B 23/032; A63B 71/085–2071/088; A61J 17/00–02; A61C 7/08; A61C 19/063–0696
See application file for complete search history.

(56) References Cited

U.S. PATENT DOCUMENTS 5,259,762 A * 11/1993 Farrell ..... A61C 7/08 433/215
6,524,262 B1 * 2/2003 Akihiro ..... A63B 23/032 482/11

* cited by examiner

*Primary Examiner* — Jennifer Robertson

(57) ABSTRACT

A safety device for motor vehicle includes a flexible hollow annular body including an arched upper base portion, an arched lower base portion and two opposing connection portions connected between the upper and lower base portions at two opposite sides, a flexible arched upper push piece having one end thereof connected to the upper base portion and an opposite end thereof extending toward the lower base portion so that a first elastic space is defined between the body and the upper push piece, and a flexible arched lower push piece having one end thereof connected to the lower base portion and an opposite end thereof extending toward the upper base portion so that a second elastic space is defined between the body and the lower push piece.

8 Claims, 6 Drawing Sheets

LIP TRAINER

BACKGROUND OF THE INVENTION

1. Field of the Invention

The present invention relates to lip training technology and more particularly to a lip trainer which uses opposing upper and lower push pieces at two opposite sides of a body thereof to elastically push the orbicular muscle of mouth and the facial expression muscles around the lips, enhancing facial muscle training.

2. Description of the Related Art

A lip trainer is used for exercising facial muscles and for opening and closing the mouth to help the facial nerves to be rehabilitated. In application, the actuating member of the lip trainer is pulled to move opposing upper and lower driven portions in exercising the orbicular muscle of mouth around the lips, achieving the effect of exercising facial muscles and maintaining muscle elasticity. However, the muscle structure in the human oral cavity is complicated. The conventional lip trainers can simply grasp the surface skin of the orbicular muscle of mouth and cannot effectively train the facial expression muscles, lowering the effect of facial muscle training.

SUMMARY OF THE INVENTION

The present invention has been accomplished under the circumstances in view. It is therefore the main object of the present invention to provide a lip trainer, which uses opposing upper and lower push pieces at two opposite sides of a body thereof to elastically push the orbicular muscle of mouth and the facial expression muscles around the lips, enhancing facial muscle training.

It is another object of the present invention to provide a lip trainer, which uses pressing portions and reinforcing ribs of the upper and lower push pieces to enhance the elasticity of the upper and lower push pieces for giving pressure to the facial muscles, increasing facial muscle training effect and strength.

To achieve these and other objects of the present invention, a lip trainer comprises a body, an upper push piece and a lower push piece. The body is made of a flexible material in a hollow annular shape, comprising an upper base portion, a lower base portion and two opposing connection portions connected between the upper base portion and the lower base portion at two opposite sides. The upper base portion and the lower base portion are arcuately formed from the center toward a front side. The upper push piece is made of a flexible material in an arched shape, having one end thereof connected to the upper base portion of the body and an opposite end thereof extending toward the lower base portion so that a first elastic space is defined between the body and the upper push piece. The lower push piece is made of a flexible material in an arched shape, having one end thereof connected to the lower base portion of the body and an opposite end thereof extending toward the upper base portion so that a second elastic space is defined between the body and the lower push piece.

DETAILED DESCRIPTION OF THE PREFERRED EMBODIMENT

Figure 1:
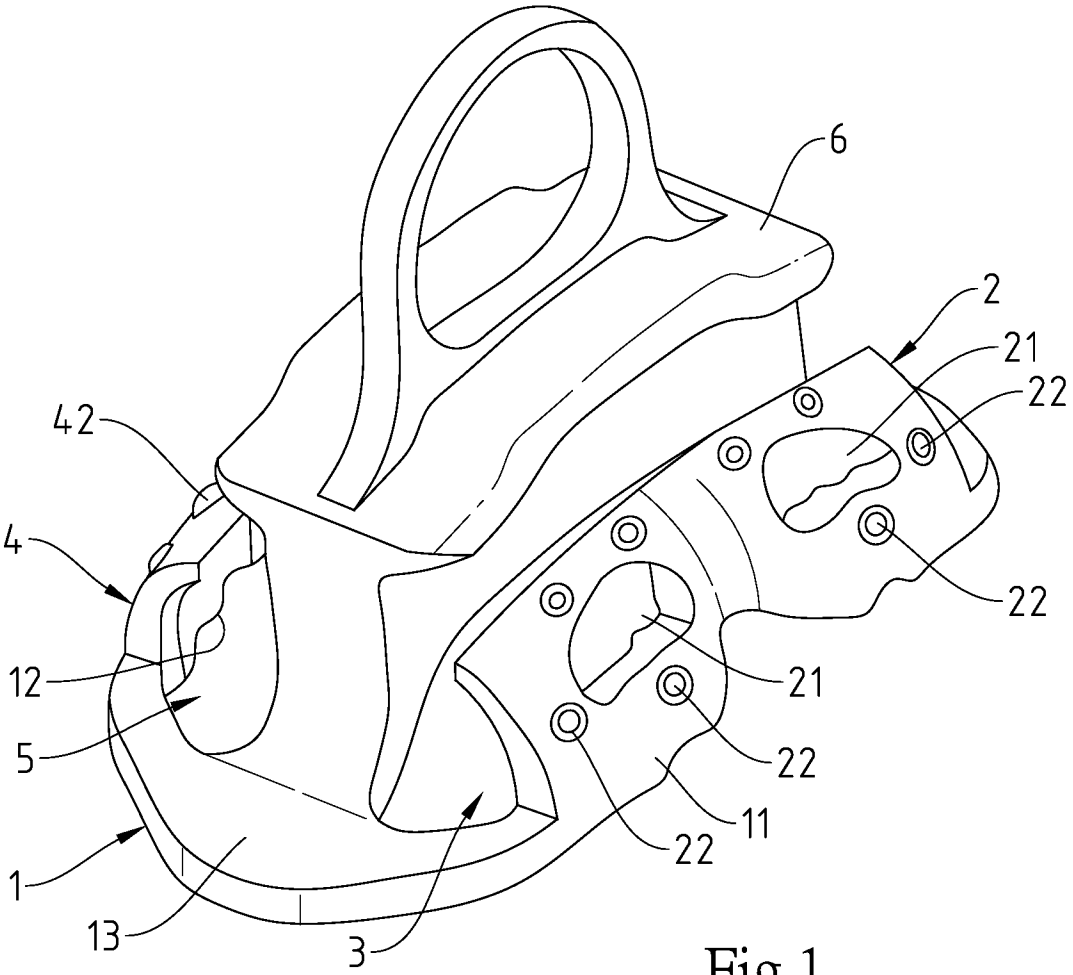
FIG. 1 is an oblique top elevational view of a lip trainer in accordance with the present invention.
Figure 2:
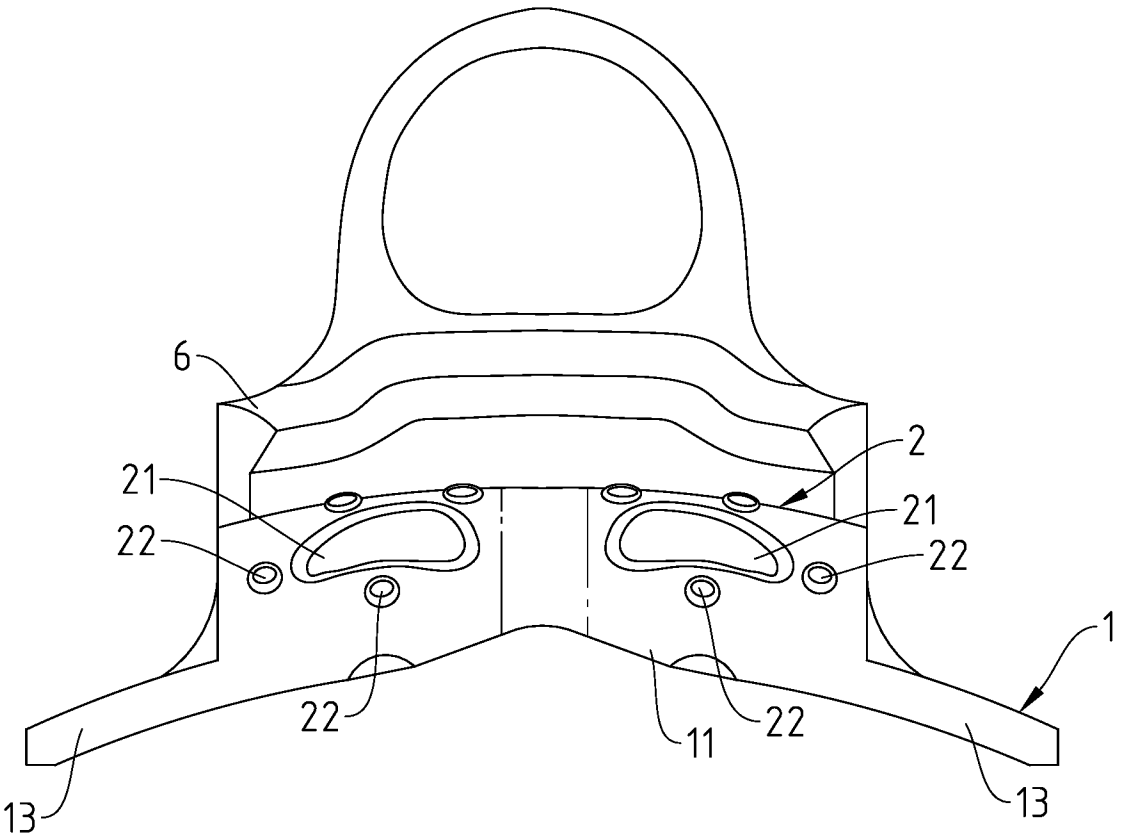
FIG. 2 is a front view of the lip trainer in accordance with the present invention.
Figure 3:
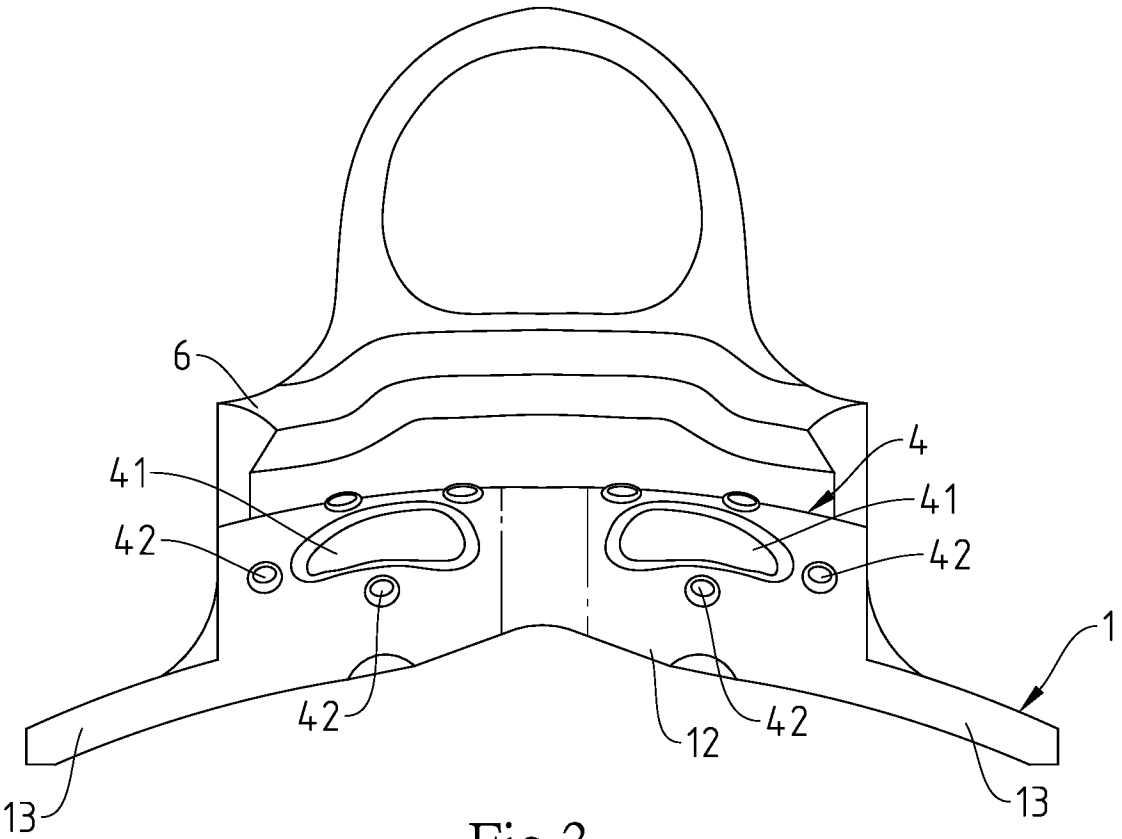
FIG. 3 is a rear view of the lip trainer in accordance with the present invention.
Figure 4:
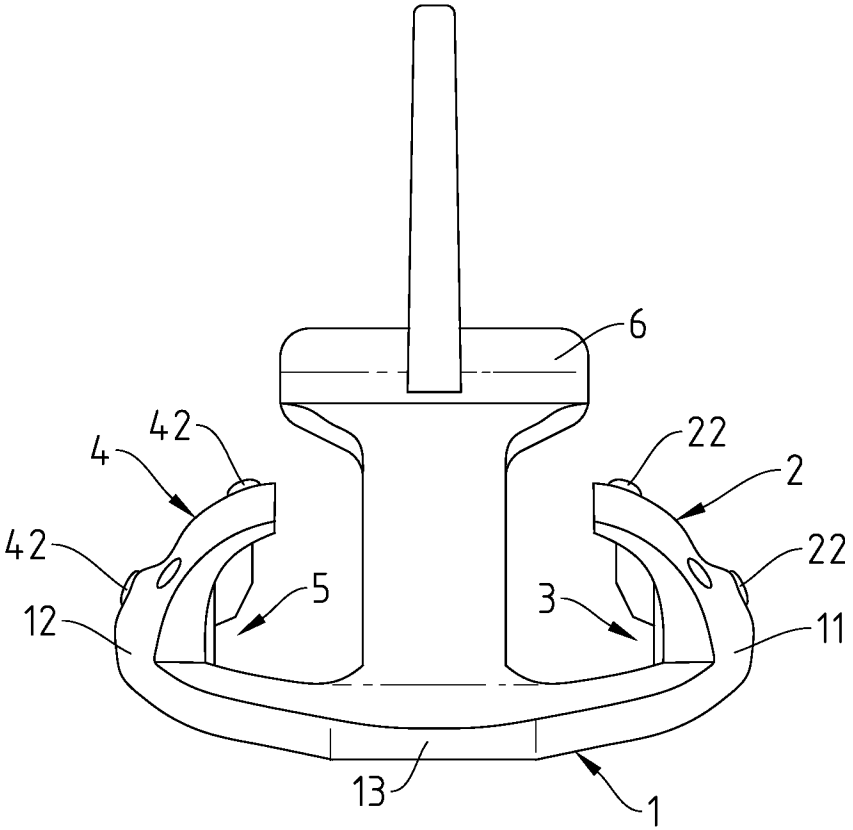
FIG. 4 is a side view of the lip trainer in accordance with the present invention.
Figure 5:
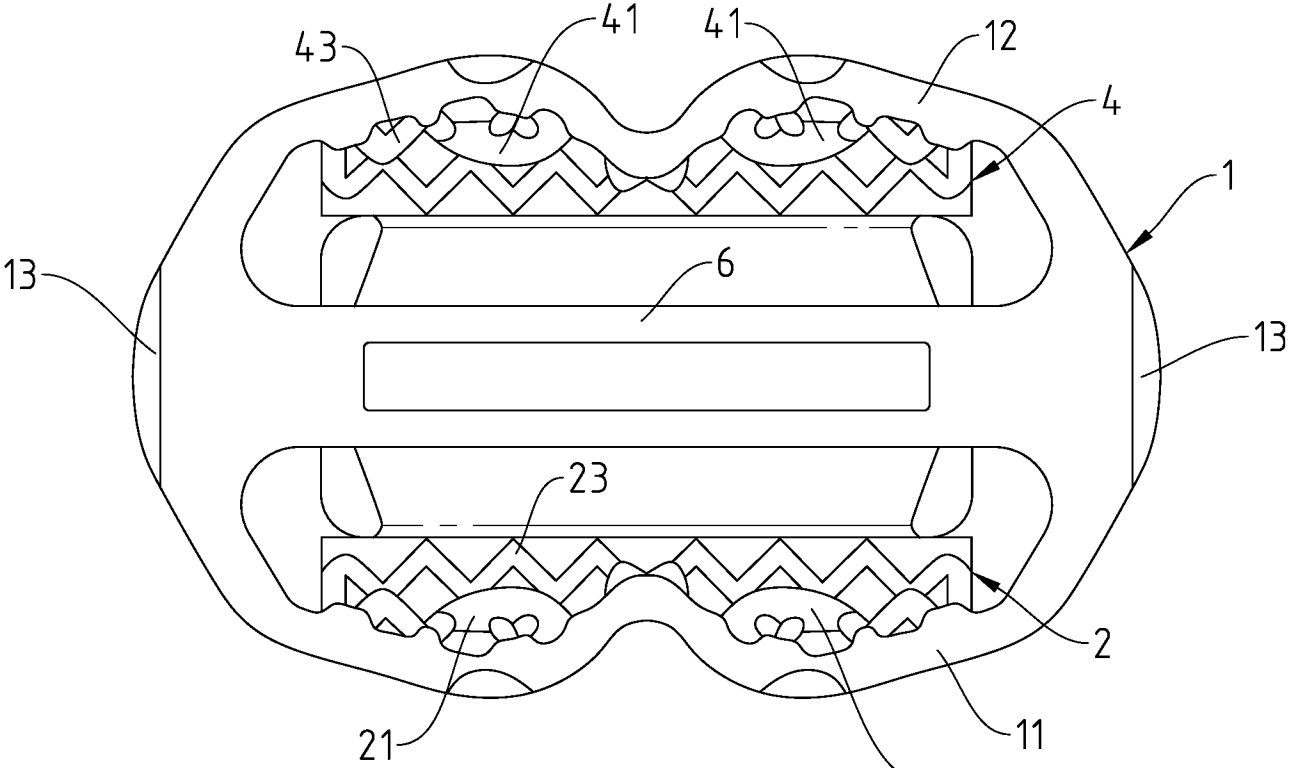
FIG. 5 is a bottom view of the lip trainer in accordance with the present invention.
Figure 6:
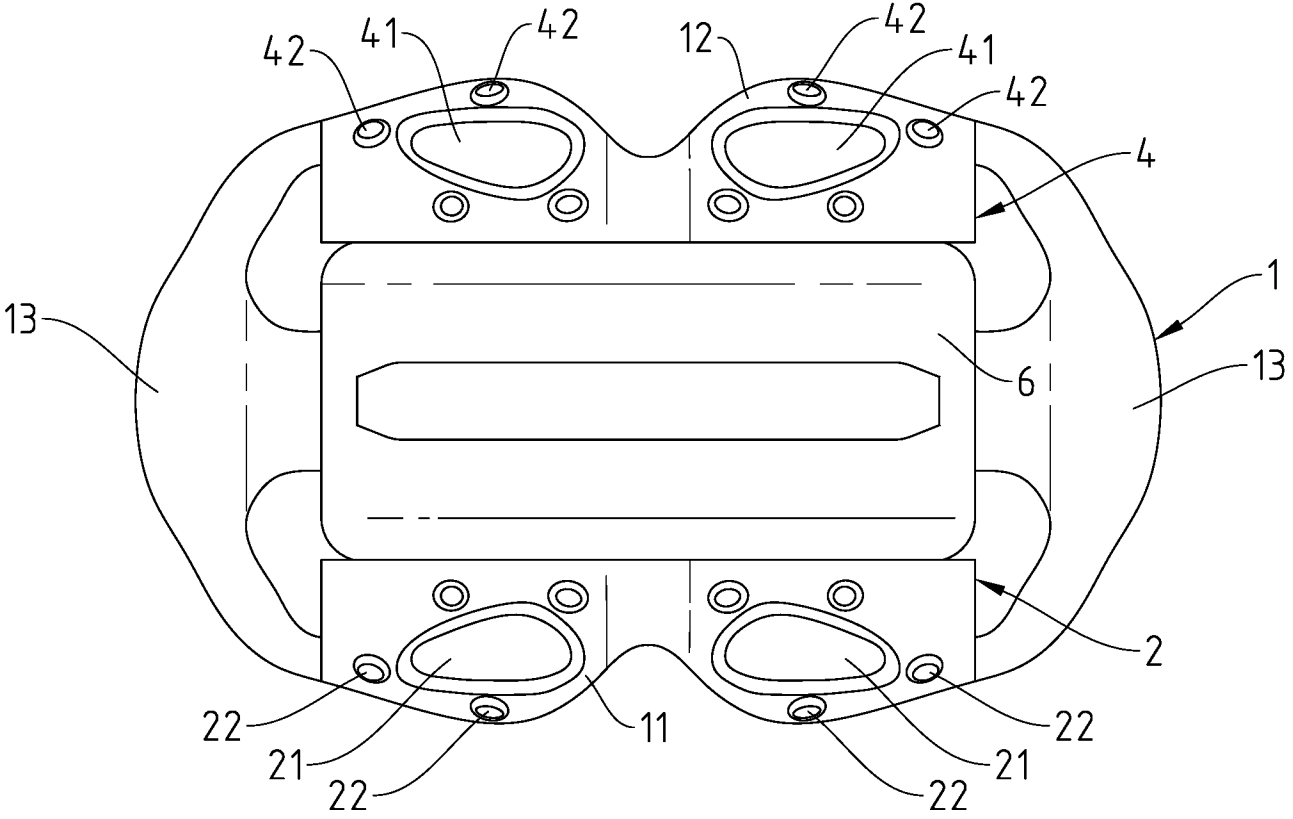
FIG. 6 is a top view of the lip trainer in accordance with the present invention.

Referring to FIGS. 1-6, a lip trainer in accordance with the present invention is shown. The lip trainer is made of a flexible material, comprising a body 1, an upper push piece 2, a lower push piece 4 and an actuating member 6.

The body 1 is a hollow annular member, comprising an upper base portion 11, a lower base portion 12 and two opposing connection portions 13 connected between the upper base portion 11 and the lower base portion 12 at two opposite sides. The upper base portion 11 and the lower base portion 12 are arcuately formed from the center toward the front.

The upper push piece 2 is arc shaped, having one end thereof connected to the upper base portion 11 of the body 1 and an opposite end thereof extending toward the lower base portion 12 so that a first elastic space 3 is defined between the body 1 and the upper push piece 2. The upper push piece 2 comprises a plurality of upper openings 21, a plurality of upper pressing portions 22 located on an outer side thereof opposite to the first elastic space 3, and a plurality of first reinforcing ribs 23 located on an opposing inner side thereof.

The lower push piece 4 is arc shaped, having one end thereof connected to the lower base portion 12 of the body 1 and an opposite end thereof extending toward the upper base portion 11 so that a second elastic space 5 is defined between the body 1 and the lower push piece 4. The lower push piece 4 comprises a plurality of lower openings 41, a plurality of lower pressing portions 42 located on an outer side thereof opposite to the second elastic space 5, and a plurality of second reinforcing ribs 43 located on an opposing inner side thereof.

The actuating member 6 is connected between the body 1 and the two connection portions 13 and suspended between the distal end of the upper push piece 2 and the distal end of the lower push piece 4.

When the lip trainer of the present invention is used, the body 1 is first placed in the human mouth. Since the upper base portion 11 and lower base portion 12 of the body 1 are arcuately formed from the center toward the front, the upper push piece 2 and the lower push piece 4 are respectively located between the front teeth and the upper and lower lips. When the user pulls the actuating member 6 to move the body 1 forward, the upper push piece 2 and the lower push piece 4 push the upper and lower lips, so that the upper push piece 2 and the lower push piece 4 are respectively deformed toward the first elastic space 3 and the second elastic space 5. When the user releases the pressure, the upper push piece 2 and the lower push piece 4 immediately return to their former shape, giving pressure to the orbicular muscle of mouth and the facial expression muscles around the lips. At this time, the user can close the upper and lower lips to generate a resistance force opposing to the aforementioned extrapolating pressure, thereby stretching the orbicular muscle of mouth and the facial expression muscles to train the facial muscles.

Furthermore, when the upper push piece 2 and the lower push piece 4 push the inner side of the lips, the upper and lower lips will be partially and evenly squeezed into the upper openings 21 and the lower openings 41, causing the upper push piece 2 and the lower push piece 4 to gently touch the mucous membranes of the lips and gums. This situation allows the user to feel comfortable and reduces the contact area between upper and lower push pieces 2,4 and the upper and lower lips. Further, the upper openings 21 and the lower openings 41 are elastically deformed when the upper push piece 2 and the lower push piece 4 are compressed, increasing the contact area between the upper push piece 2 and the lower push piece 4 and the inner side of the upper and lower lips. At the same time, the upper pressing portions 22 and the lower pressing portions 42 massage the inner side of the upper and lower lips, enhancing the training effect. Furthermore, the first reinforcing ribs 23 and the second reinforcing ribs 43 enhance the pressure exerted by the upper push piece 2 and the lower push piece 4 on the facial muscles, increasing the training intensity.

What the invention claimed is:

1. A lip trainer, comprising a body made from a flexible material and having a hollow annular shape, the body comprising an upper base portion, a lower base portion and two opposing connection portions connected between said upper base portion and said lower base portion at two opposite sides, said upper base portion and said lower base portion being arcuately formed;

an arced upper push piece made from a flexible material, the upper push piece having one end thereof connected to said upper base portion of said body and an opposite end thereof extending away in an arc from said upper base portion and toward said lower base portion so that a first elastic space is defined between said body and said upper push piece within the hollow annular shape; and an arced lower push piece made from a flexible material, the lower push piece having one end thereof connected to said lower base portion of said body and an opposite end thereof extending away in an arc from said lower base portion and toward said upper base portion so that a second elastic space is defined between said body and said lower push piece within the hollow annular shape.

2. The lip trainer as claimed in claim 1, wherein said upper push piece comprises a plurality of upper openings.

3. The lip trainer as claimed in claim 1, wherein said upper push piece comprises a plurality of upper pressing portions located on one side thereof opposite to said first elastic space.

4. The lip trainer as claimed in claim 1, wherein said lower push piece comprises a plurality of lower openings.

5. The lip trainer as claimed in claim 1, wherein said lower push piece comprises a plurality of lower pressing portions located on one side thereof opposite to said second elastic space.

6. The lip trainer as claimed in claim 1, wherein said upper push piece comprises a plurality of reinforcing ribs located on one side thereof facing toward said first elastic space.

7. The lip trainer as claimed in claim 1, wherein said lower push piece comprises a plurality of reinforcing ribs located on one side thereof facing toward said second elastic space.

8. The lip trainer as claimed in claim 1, further comprising an actuating member connected between said body and said two connection portions and disposed between the distal end of said upper push piece and the distal end of said lower push piece.

* * * * *